United States Patent [19]

Dante

[11] 4,372,211

[45] Feb. 8, 1983

[54] THERMOELECTRIC POWER SUPPLY FOR WARHEADS

[75] Inventor: James G. Dante, Churchville, Md.

[73] Assignee: The United States of America as represented by the Secretary of the Army, Washington, D.C.

[21] Appl. No.: 140,029

[22] Filed: Apr. 14, 1980

[51] Int. Cl.[3] ..... F42C 11/00; H01L 35/14

[52] U.S. Cl. ..... 102/207; 136/212

[58] Field of Search ..... 102/207; 136/212

[56] References Cited

U.S. PATENT DOCUMENTS

| | | | |
|---|---|---|---|
| 2,519,785 | 8/1950 | Okolicsanyi | 136/212 |
| 3,019,278 | 1/1962 | Fischer | 136/212 |
| 3,088,988 | 5/1963 | Menke | 102/207 |
| 3,293,082 | 12/1966 | Brouwer et al. | 136/212 |
| 3,441,449 | 4/1969 | Green | 136/212 |
| 3,946,675 | 3/1976 | Stalfors | 102/207 |

*Primary Examiner*—Charles T. Jordan

*Attorney, Agent, or Firm*—Nathan Edelbert; Robert P. Gibson; Max Yarmovsky

[57] ABSTRACT

In a round assembly having a propellant and an igniter for activating the propellant, a thermoelectric power supply comprising a plurality of junctions, which are coupled to the propellant for sensing the propellant temperature, and means of generating a voltage in response to the temperature sensed by the junctions.

10 Claims, 3 Drawing Figures

THERMOELECTRIC POWER SUPPLY FOR WARHEADS

GOVERNMENTAL INTEREST

The invention described herein may be manufactured, used and licensed by or for the Government for governmental purposes without the payment to me of any royalties thereon.

BACKGROUND OF THE INVENTION

This invention relates to ordinance devices. More specifically, this invention relates to the conversion of hot gases produced from burning propellant into electrical energy for use in weapons such as bombs, artillery projectiles and the like.

Electrical energy in a round has always been at a premium. Thermal batteries, piezoelectric elements and mercury cells have been the principal sources of electrical power in large caliber munitions. In thermal batteries, where the voltage output depends on the number of cells used, a considerable volume of space must be taken up for devices requiring a high voltage level or a long operating time. Mercury cells must be stacked to obtain appropriate voltage levels adding weight and increasing the volume of needed space. Piezoelectric elements have been placed in the nose of an ogive to produce electrical energy upon impact of the warhead. However, piezoelectric elements located in the nose offer only a limited area of impact, and the voltage output is a function of the impact angle, falling off as the angle increases.

This produced energy is allowed to pass through a detonator. The detonator is comprised of a thin wire surrounded by a sensitive explosive, such as lead-azide. Current passing through a wire heats the wire and causes the lead-azide to explode. Explosion of the lead-azide causes the main explosive charge in the warhead to detonate.

In the case of the piezoelectric elements, electrical energy is produced by pressure. As the element upon impact is compressed along a certain axis, an electrical charge is generated. This charge is then passed through the detonator causing it to explode and initiate the explosive in the warhead.

In the case of the thermal battery, the electrical energy is produced by set-back forces which are generated when the round is fired. A fuzed salt is released on set-back, which subsequently causes an electrical charge to be generated between two electrodes, similar in process to the lead storage battery. This charge is then stored in a capacitor and used to set off the detonator upon impact of the warhead.

In small caliber munitions (20 mm to 40 mm) electrical energy is virtually non existent. Some rounds incorporate piezo-electric elements similar in operation to those used in large caliber munitions. Most rounds, however, incorporate a point detonating type fuze and rely on the round's impact on target to initiate the warhead's explosive train. A spring-loaded pin is driven into the detonator with sufficient force to cause detonation. This type of initiating system reduces the warhead's functioning sensitivity when the warhead impacts at large oblique angles.

Also used in small caliber munitions is the "spitter" point detonator fuze which is a small shaped charge located in front of the ogive. On impact, the spitter shaped charge is activated and a stream of particles is projected from the front of the ogive back into a tube at the apex of the shaped charge, and subsequently causes the explosive at the top of the tube to detonate.

These prior art devices have been found to contain the following disadvantages:

1. In large caliber munitions, thermal batteries and mercury cells require a considerable volume of space, necessitating minimization of the amount of high explosive for a given warhead size.

2. In large caliber munitions, thermal batteries and mercury cells increase the weight of the warhead, necessitating an increase in the amount of propellant needed to maintain projectile velocity.

3. In small caliber munitions, electrical energy is virtually non-existent. Consequently, electronic timing fuzes cannot be used.

4. Piezo-elements in the nose of the ogive offer only a limited area of impact on the ogive where the fuze can cause the warhead to function. Electro-optical fuzing systems, which possess greater graze functioning sensitivity with negligible increase in weight and volume, cannot be used in small caliber munitions without availability of electrical energy.

5. When spit-back fuzes are used, the material in the fuze sits in the path of the jet, and the activation of the spitter causes some damage to the warhead.

Accordingly, it is a primary object of this invention to provide the necessary electrical energy to operate any electronic devices in the round, as well as to insure the initiation of the warhead's explosive train, without the use of thermal batteries or mercury cells. Integrated with a compatible impact sensor, such as a triboluminescent sensor or a double walled ogive switch, the thermoelectric power supply could supply the required power in the fuze system to initiate the warhead's explosive train.

A still further object of this invention is to provide a considerable saving in weight and volume when utilizing this power supply. Any guidance or timing devices could be integrated into a single monolithic chip and could receive the necessary power to operate from the thermoelectric power supply.

Yet another object of this invention is to make electrical energy available in small caliber munitions. These rounds can, with this invention, incorporate electronic timing fuzes or electro-optical fuzing systems with negligible increase in weight and volume. With the removal of the point detonating type fuze, rounds such as the M552 which utilize shape charge liners will be made more effective, since the jet which is formed will no longer have to pass through the fuze debris.

A further object of this invention is that high explosive dual purpose rounds utilizing shallow cone shape charges can be developed for use in the newer gun systems having higher velocities and spin rates.

SUMMARY OF THE INVENTION

The present invention relates to the generation of electrical energy from hot gases produced from burning propellant. It is based on an adaptation of the thermoelectric effect, in which two dissimilar materials are joined together to form a sensing junction. By causing the junction to be heated, a voltage can be generated. A significant voltage can be generated which is proportional to the amount of heat produced by the propellant and the number of junctions utilized in the power supply.

Integrated with a compatible impact sensor such as the triboluminescent sensor or the double walled ogive switch, the thermoelectirc power supply can supply the required power in the fuze system to initiate the warhead's explosive train.

In accordance with the present invention, hot gases from the burning propellant heat the sensing junctions of the thermoelectric power supply, causing a voltage to be generated and stored in a capacitor. The warhead, by way of an impact sensor, causes a switch to be activated upon impacting the target. This allows the voltage generated by the thermoelectric power supply and stored in the capacitor to flow through the detonator causing the warhead's explosive to detonate.

BREIF DESCRIPTION OF THE DRAWINGS

The precise nature and operation of the present invention will be better understood with reference to the following drawings.

DESCRIPTION OF ILLUSTRATIVE EMBODIMENTS

Figure 1:
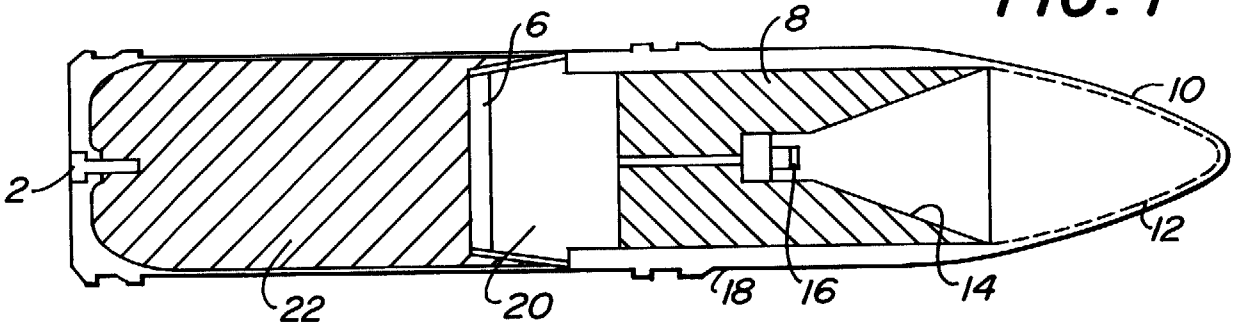
FIG. 1 is a cross-sectional view of a round assembly with a light activated fuze and the thermoelectric power supply of the present invention.

FIG. 1 shows thermoelectric power supply 6 located within round assembly 18. Operation of thermoelectric power supply 6 is based on general laws of thermoelectric phenomena in which a plurality of two dissimilar materials are joined together to form sensing junctions. By causing the junctions to be heated, a voltage can be generated. The manner in which the junctions are constructed is well known in the art of thermoelectric batteries and will be described in more detail later.

The source of heat needed for the operation of thermoelectric power supply 6 is propellant 22, shown in FIG. 1. Hot gases are generated whenever propellant 22 is activated by way of igniter 2. The hot gases cause the junctions of thermoelectric power supply 6 to be heated thereby generating a resultant voltage output. A significant voltage can be generated which is proportional to the number of junctions in the thermoelectric power supply and the amount of heat available from propellant 22. The generated voltage can be used to operate any electronic devices in the round, as well as to insure the initiation of the warhead's explosive train.

High explosive 8, shown in FIG. 1, is ignited when current from thermoelectric power supply 6 is allowed to flow through the detonator (not shown in FIG. 1). The manner in which thermolectric power supply 6 operates with the detonator will be explained later.

It will be understood that the detonator is kept mechanically out of line with the high explosive component to insure that high explosive 8 is not detonated prematurely. This is done by way of safety and arming mechanism 20. The operation of safety and arming mechanism 20 is well understood in the art and is not explained herein.

Additional control upon the current flow from thermoelectric power supply 6 to high explosive component 8 is provided by way of an ON/OFF switch. This switch may be activated in various ways. By way of example, FIG. 1 shows a light activated silicon-controlled-rectifier (SCR) 16 that is located at the apex of a conical shaped charge liner 14. The manner in which SCR 16 operates with thermoelectric power supply 6 will be explained in detail later.

FIG. 1 also shows an ogive 10 having coated on the inside of the ogive triboluminescent material 12. The triboluminescent material 12 is coated on the entire inside surface of the ogive, and emits light when impacted. Whenever any part of the ogive strikes the target, triboluminescent material 12 produces light. The light which is generated is received by SCR 16. If sufficient light is received by SCR 16, the current from thermoelectric power supply 6 will be allowed to pass through the detonator thereby activating the explosive train.

When the round is fired, hot gases from burning propellant 22 heat the sensing junctions of thermoelectric power supply 6.

Figure 3:
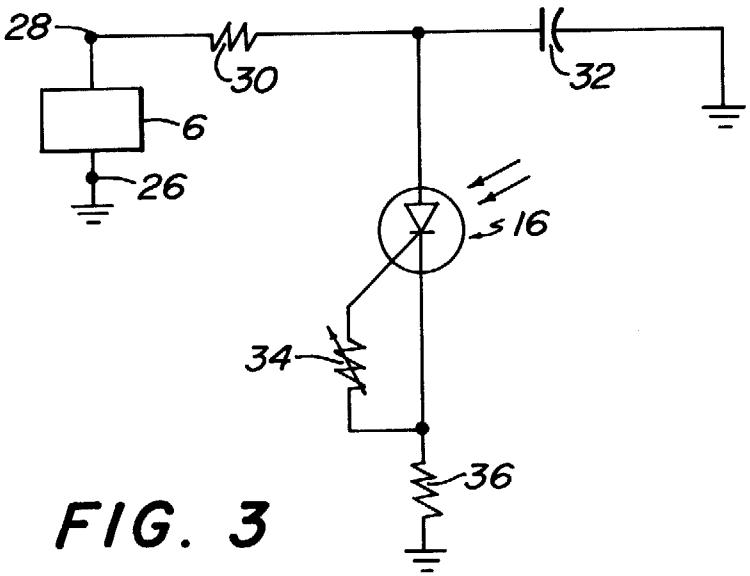
FIG. 3 is a schematic diagram of a possible fuze circuit in accordance with the present invention.

This causes a voltage to be generated by thermoelectric power supply 6. The voltage developed charges capacitor 32 by way of charging resistor 30, as shown in FIG. 3.

The warhead on impacting the target by way of ogive 10, generates a light pulse from triboluminescent coating 12 which in turn causes SCR 16 to be gated on. The SCR has a large impedance in the "off" position, but when activated by light has a much lower impedance. Sensitivity control means 34, such as the gating-cathode resistance shown in FIG. 3, may be utilized to control the light sensitivity of SCR 16. When sufficiently intense light strikes SCR 16 and activates the circuit, current from thermoelectric power supply 6 is allowed to flow through detonator 36 and thereby activate high explosive 8.

It will be understood that detonator 36 is comprised of a thin wire resistor surrounded by a sensitive explosive, such as lead-azide. Current passing through detonator 36 causes the lead azide to explode. The lead azide, in turn, causes the high explosive to detonate.

Figure 2:
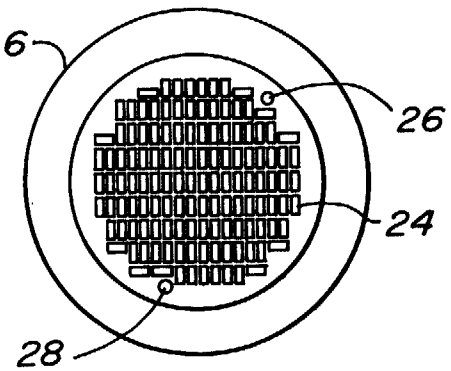
FIG. 2 is a planar view of a possible thermoelectric power supply having 130 junctions.

The number of junctions determines the overall voltage output of the power supply; the greater the number of junctions, the greater the voltage output. When a number of these junctions are connected in series, the resultant voltage output is the sum of the voltages generated at each junction. FIG. 2 shows the planar view of a thermoelectric power supply having 130 junctions. Power supply 6 can be inserted into the base of round 18, as shown in FIG. 1, with one side of the junctions facing propellant 22. The power supply can be equipped with two-pins 26 and 28 which could be inserted into corresponding sockets in the base of the round to provide electrical connection.

The junctions may be made from various types of wire utilized in thermocouples such as chromel-alumel, and iron-constantan or from semiconductor material such as silicon, bismuth-telluride, lead telluride, bismuth-antimonide or any other material having good thermoelectric characteristics. The geometrical arrangement of the junctions may assume any shape that will insure maximum utilization of the available heat. By putting the semiconductor material into "n" and "p" type arrangements the electrical conductivity of the material is increased.

The present invention will be further understood from the following.

EXAMPLES

Initial sensors were fabricated with chromel-alumel 0.025 mm wire. A single hot junction of the thermoelectric power supply was bonded to thin stainless steel discs whose thicknesses were 0.254 mm, 0.127 mm and 0.051 mm. These were inserted into a closed chamber to simulate the actual gun firing environment. Using 21.8 gms. of Dupont IMR8061 propellant the pressure in the closed chamber was adjusted through the use of blow-out discs to model approximately the pressure profile of a 30 mm round. An average peak pressure of 200 Mega Pascals (MPa) was obtained. Table I gives the results of the tests using the chromel-alumel wire. Some of the modules were coated with a thin heat absorber. Use of such an absorber helps protect the module's surface and acts as a heat sink as the round is propelled to its target.

More complex modules were then constructed. These possessed 15 junctions which were composed of bismuth-telluride. The results of closed chamber firings with these modules are listed in Table II.

Modules were then fabricated to accommodate 130 junctions. These results are also shown in Table II.

TABLE I

Thermoelectric Module Response
Element: Chromel-Alumel 1 mil Wire
Propellant: 21.8 gms Dupont IMR 8061

| Sample No. | Sensor | Pressure (MPa) | Voltage Output (mv) |
|---|---|---|---|
| 1 | SS.005 | 199 | 11.00 |
| 2 | SS.002 | 200 | 17.65 |
| 3 | SS.010 | 198 | 4.24 |
| 4 | SS.010 | 204 | 3.21* |
| 5 | SS.010 | 204 | 4.47 |
| 6 | SS.005 | 199 | 6.17* |
| 7 | SS.005 | 206 | 8.07 |
| 8 | SS.002 | 201 | 8.22* |

*Indicates coated samples

TABLE II

Thermoelectric Module Response
Element: Bismith-Telluride
Propellant: 21.8 gms Dupont IMR 8061

| Sample No. | Module | Pressure (MPa) | Voltage Output (Volts) |
|---|---|---|---|
| 1 | .002 AA (15) | 222 | 0.95 |
| 2 | .002 AB (15) | 212 | — (heads broke) |
| 3 | .002 AC (15) | 217 | 0.74* |
| 4 | .002 AD (130) | 191 | 1.30* |
| 5 | .002 AE (130) | 169 | 8.37 |
| 6 | .002 AF (130) | — | — (broke) |

*Indicates coated samples

It should be understood that I do not desire to be limited to the exact details of the construction shown and described, for obvious modifications can be made by a person skilled in the art.

I claim:

1. In a round assembly having a propellant, an igniter for activating said propellant, explosive material, and a detonator for activating said explosive material, a fuze comprising:

(a) an impact sensor for sensing impact of said round assembly, which includes;
a triboluminescent material coated on the inside surface of an ogive contained within said round assembly;

(b) a thermoelectric power supply comprising a plurality of junction means coupled to said propellant for sensing said propellant temperature, and voltage generating means in response to temperature sensed by said junction means, including;
storage means for storing said voltage generated by said thermoelectric power supply, and (c) means responsive to said impact sensor and communicating with said detonator so as to cause the detonator to activate and detonate the explosive.

2. The assembly of claim 1 wherein means responsive to said impact sensor is comprised of a photo-sensitive detector for detecting the light caused by said triboluminescent material upon impact of said round assembly.

3. The assembly of claim 2 wherein means communicating with said detonator is comprised of gating means enabling power stored in said storage means to pass through said detonator so as to detonate said explosive.

4. The assembly of claim 3 including sensitivity control means for controlling activation of said gating means.

5. The assembly of claim 1 or 2 wherein said junction means are comprised of chromel-alumel material.

6. The assembly of claim 1 or 2 wherein said junction means are comprised of iron-constantan material.

7. The assembly of claim 1 or 2 wherein said junction means are comprised of silicon material.

8. The assembly of claim 1 or 2 wherein said junction means are comprised of bismuth-telluride material.

9. The assembly of claim 1 or 2 wherein said junction means are comprised of lead-telluride material.

10. The assembly of claim 1 or 2 wherein said junction means are comprised of bismuth-antimonide material.

* * * * *